US010184275B2

(12) United States Patent
Harris

(10) Patent No.: US 10,184,275 B2
(45) Date of Patent: Jan. 22, 2019

(54) BUTTERFLY HANDLE LOCKING DEVICE

(71) Applicant: David R. Harris, El Granada, CA (US)

(72) Inventor: David R. Harris, El Granada, CA (US)

( * ) Notice: Subject to any disclaimer, the term of this patent is extended or adjusted under 35 U.S.C. 154(b) by 0 days.

(21) Appl. No.: 15/273,148

(22) Filed: Sep. 22, 2016

(65) Prior Publication Data

US 2018/0080261 A1 Mar. 22, 2018

(51) Int. Cl.
*E05B 73/00* (2006.01)
*E05B 15/16* (2006.01)
*E05B 67/38* (2006.01)

(52) U.S. Cl.
CPC ..... *E05B 73/007* (2013.01); *E05B 15/16* (2013.01); *E05B 67/383* (2013.01); *E05B 73/0005* (2013.01)

(58) Field of Classification Search
CPC ..... E05B 73/00; E05B 73/007; E05B 73/0094
See application file for complete search history.

(56) References Cited

U.S. PATENT DOCUMENTS 4,409,804 A * 10/1983 Sork ..... B62H 5/12 70/14
4,680,949 A * 7/1987 Stewart ..... E05B 73/007 70/14
4,996,855 A * 3/1991 Havenga ..... B60D 1/60 70/14
5,109,683 A * 5/1992 Cartwright ..... B63B 35/7946 70/14
5,233,938 A 8/1993 Lalo
6,263,709 B1 * 7/2001 Kemery ..... A63C 11/006 70/14
6,691,537 B2 * 2/2004 Tan ..... B63B 35/7933 403/315
7,237,410 B2 * 7/2007 Millist ..... B63B 35/7933 70/14
7,294,032 B1 * 11/2007 Ventura ..... B63J 99/00 441/75
7,377,136 B1 * 5/2008 DeMartinis ..... E05B 73/0005 70/14
7,640,772 B2 * 1/2010 Johnson ..... E05B 73/0005 114/172
8,777,683 B2 7/2014 Friedman
9,315,246 B2 4/2016 Friedman
2017/0175425 A1 * 6/2017 Westbrook ..... E05B 73/007

OTHER PUBLICATIONS http://standuplock.com.
https://www.amazon.com/WindPaddle-Sails-SUP-Lock-Black-Size/dp/B01HYJD82G.
https://ww.paddlesurfwarehouse.com/stand_up_paddle_board_buyers_guide.

* cited by examiner

*Primary Examiner* — Christopher J Boswell
(74) *Attorney, Agent, or Firm* — Ray K. Shahani, Esq.

(57) ABSTRACT

A butterfly handle locking device that fits into the standard butterfly handle such as found on sportsboards, sportscraft and other objects, the locking device having two main body portions that fit together, each body portion having an extending flange and a central region with an axial bore extending therethrough, the two main body portions each having a wing arm extending from the central region, the two main body portions coupled together with an axle that passes through the axial bore of each.

8 Claims, 11 Drawing Sheets

BUTTERFLY HANDLE LOCKING DEVICE

RELATED APPLICATIONS

None

FIELD OF THE INVENTION

The present invention is a method and apparatus for securing a sportsboard such as a stand-up-paddle board or surf board or other object containing a butterfly handle, using a standard padlock and cable or chain.

BACKGROUND OF THE INVENTION

Sportsboards and sportscraft of all types, including stand-up-paddle (SUP) boards and surf boards, body boards also known as boogie boards, kite boards, windsurfers, kayaks and the like often have one or more butterfly handles located on the sportsboard or sportscraft for more convenient carrying or transporting.

FIG. 1A (prior art) is an isometric view of a typical butterfly handle for sportsboards and sportscraft. FIG. 1B (prior art) is representative view of a method of use of a typical butterfly handle for sportsboards and sportscraft. FIG. 1C (prior art) is section view of a typical butterfly handle installed on a sportsboard or sportscraft.

A typical butterfly handle 90 is essentially rectangular in shape. An outer housing has 4 exterior sides 92 which define an interior space 94. The top portion 96 has two rectangular upper surfaces 98 which are flat and which transform into downward curved sections 88 which further define the interior space 94. In cross section as best shown in FIG. 1C, the downward curved sections 88 form two separate lobes or ergonomic handle portions 86. These lobe-shaped handles 86 are useful for carrying the sportsboard or sportscraft 80 as best shown in FIG. 1B.

One of the problems associated with securing sportsboards of all types is connecting a padlock, chain or cable to the board in order to secure it to something less portable such as a vehicle, inside a garage or other enclosure, to a tree, to a post, furniture, a dock, etc. Other than possibly a firebox, a deck plug for attaching a tether typically on the upper surface of the sportsboard, and or one or more butterfly handles 90 placed into the sportsboard 80 at one or more locations, there is nothing on a typical sportsboard 80 big enough to couple a padlock or cable to. The butterfly handle 90 would make a convenient locking location for inserting a locking device to secure the sportsboard permanently or more safely.

U.S. Pat. Nos. 8,777,683 and 9,315,246 both to Friedman teach self-cleaning retractable handle assembly for watercraft. This handle has multiple mechanical parts, has to be installed into the sportscraft, and could easily be broken by vandals or thieves. It also does not work with existing butterfly handles 90 that are commonly used on sportsboards and sportscraft 80.

Another SUP and surf board locking device the fits into a common type of handle is called a Stand Up Lock (trademark). http://standuplock.com/ This device is merely 2 pieces of angled metal that when inserted into a deck grip or similar butterfly handle and padlocked together can't be removed from the handle. One disadvantage of this lock is that the two angled pieces fit loosely inside the handle and are subject to tampering, whereas a locking device that fits snugly inside the butterfly handle without "wiggle room" is preferred. Another drawback to this type of lock is that it has 2 separate pieces, and along with the padlock and/or cable the entire assembly comprises a number of components. A sportsboard and sportscraft locking device that is unitary would be easier to install and store when not in use.

Another SUP and surf board locking device the fits into butterfly handle called the "Wind Paddle Sails SUP-Lock" (trademark) also has 2 separate parts that secure to a padlock or cable and lock. https://www.amazon.com/WindPaddle-Sails-SUP-Lock-Black-Size/dp/B01HYJD82G

SUMMARY OF INVENTION AND ADVANTAGES

The present invention is a sportsboard and sportscraft locking device that fits inside a standard butterfly handle and provides a mechanism for securing the sportsboard to a permanent or other safe location using typical padlocks, cables and chains.

An embodiment of the sportsboard and sportscraft locking device of the present invention has two main body portions that fit together. Each main body portion has a central region with an axial bore. A flange having a shackle bore extends from the central region of each main body portion in a plane perpendicular to the central axis, with the flange on a first main body portion immediately adjacent the flange on a second main body portion. A wing arm or similar structure extends from the central axis of each main body portion. The two main body portions are secured together in axial alignment by an axle.

Thus, when the flanges on the main body portions are pivoted such that the flanges are away from each other, the wing arm structures of the two main body portions pivot closer together. However, when the flanges are pivotted together so that they overlap and the shackle bores line up, the wing arms pivot away from each other, into a fully spread open position.

An advantage of the present invention is that the two main body portions are secured together by an axle, such as a nut and bolt, so the entire device is a unitary assembly.

Another advantage of the present invention is that it provides a mechanism for temporarily attaching a padlock and/or cable and chain to the sportsboard or sportscraft to secure it safely.

Another advantage of the present invention is that it uses an existing butterfly handle for temporarily attaching a padlock and/or cable and chain to the sportsboard or sportscraft to secure it safely.

Benefits and features of the invention are made more apparent with the following detailed description of a presently preferred embodiment thereof in connection with the accompanying drawings, wherein like reference numerals are applied to like elements.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1A:
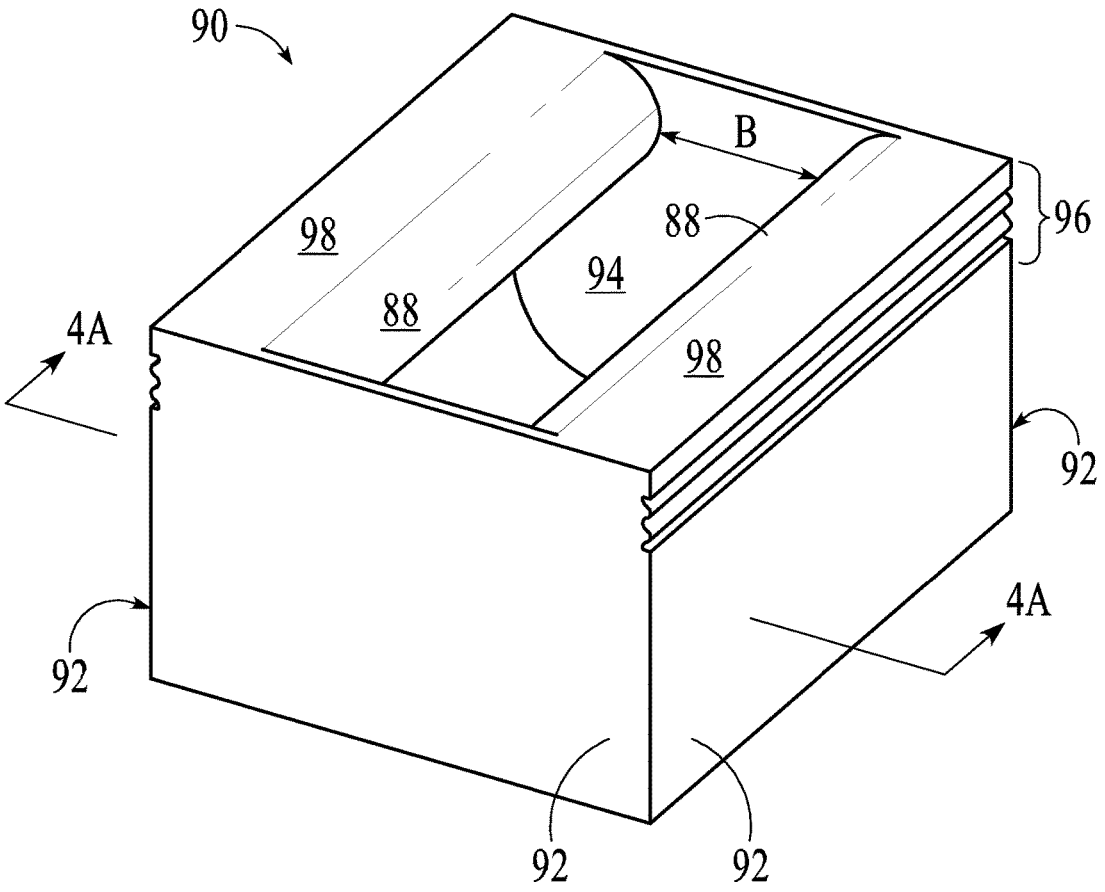
FIG. 1A (PRIOR ART)
FIG. 1A (prior art) is an isometric view of a typical butterfly handle for sportsboards and sportscraft.
Figure 1B:
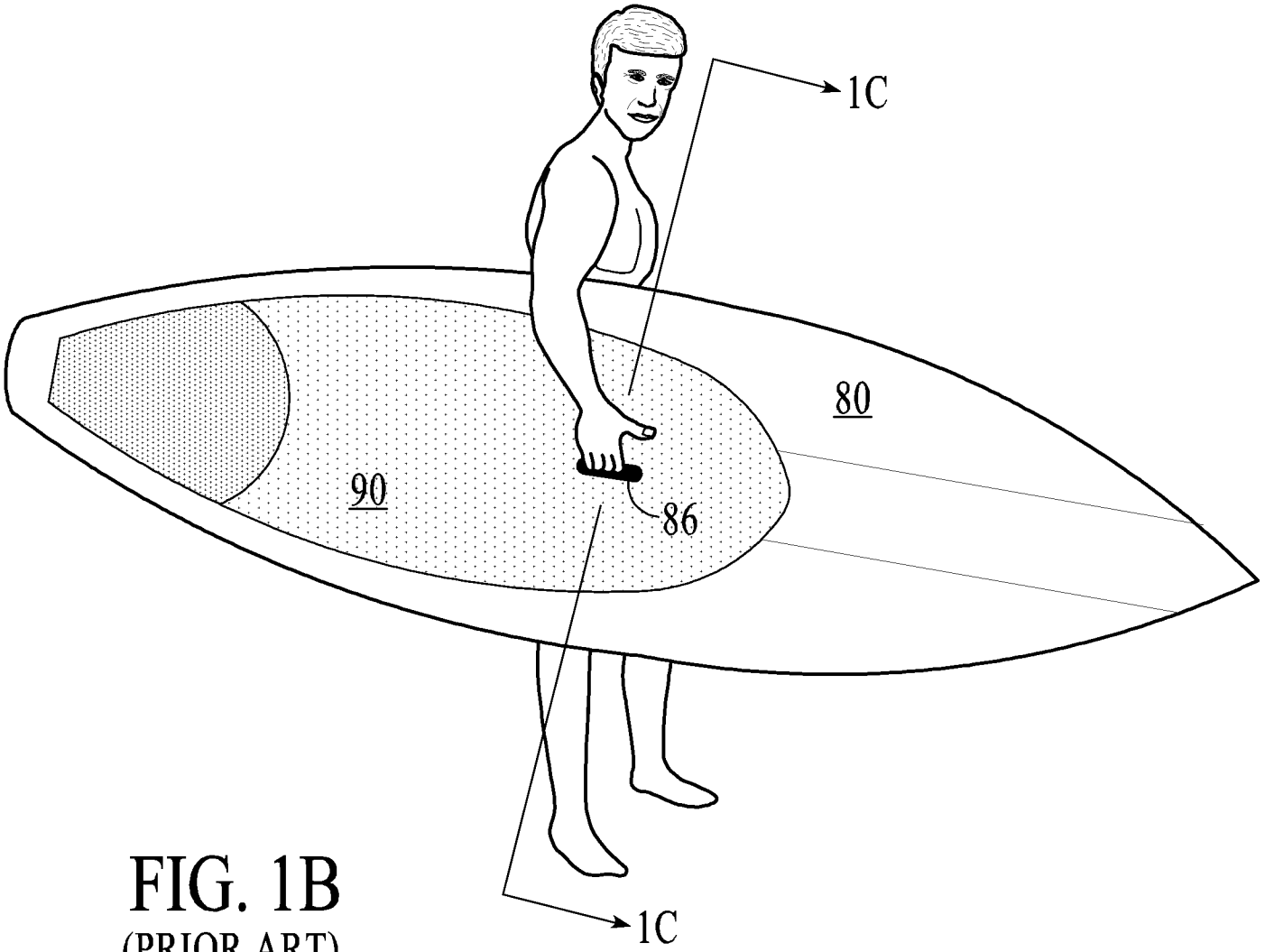
FIG. 1B (PRIOR ART)
FIG. 1B (prior art) is representative view of a method of use of a typical butterfly handle for sportsboards and sportscraft.
Figure 1C:
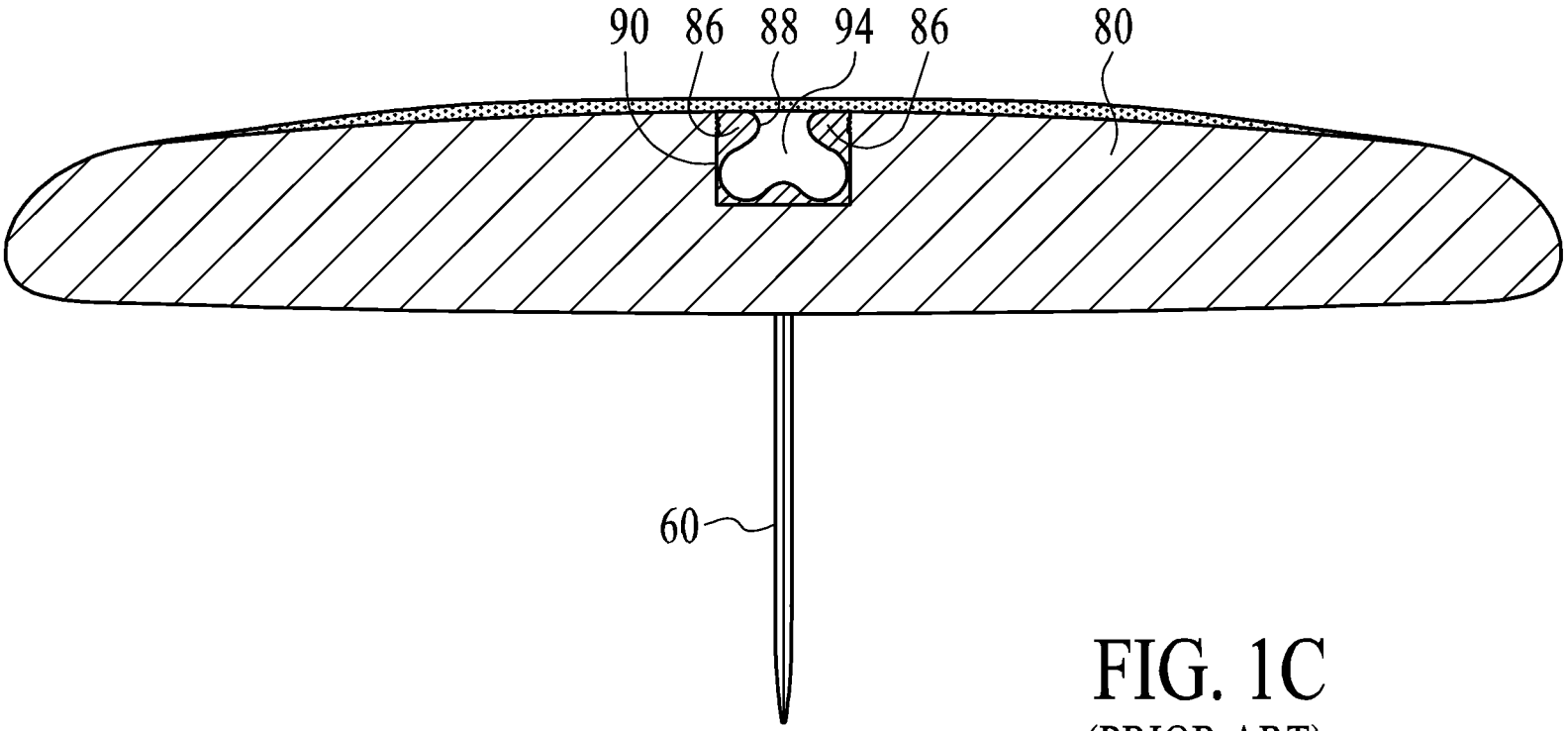
FIG. 1C (PRIOR ART)
FIG. 1C (prior art) is section view of a typical butterfly handle installed on a sportsboard or sportscraft.
Figure 2:
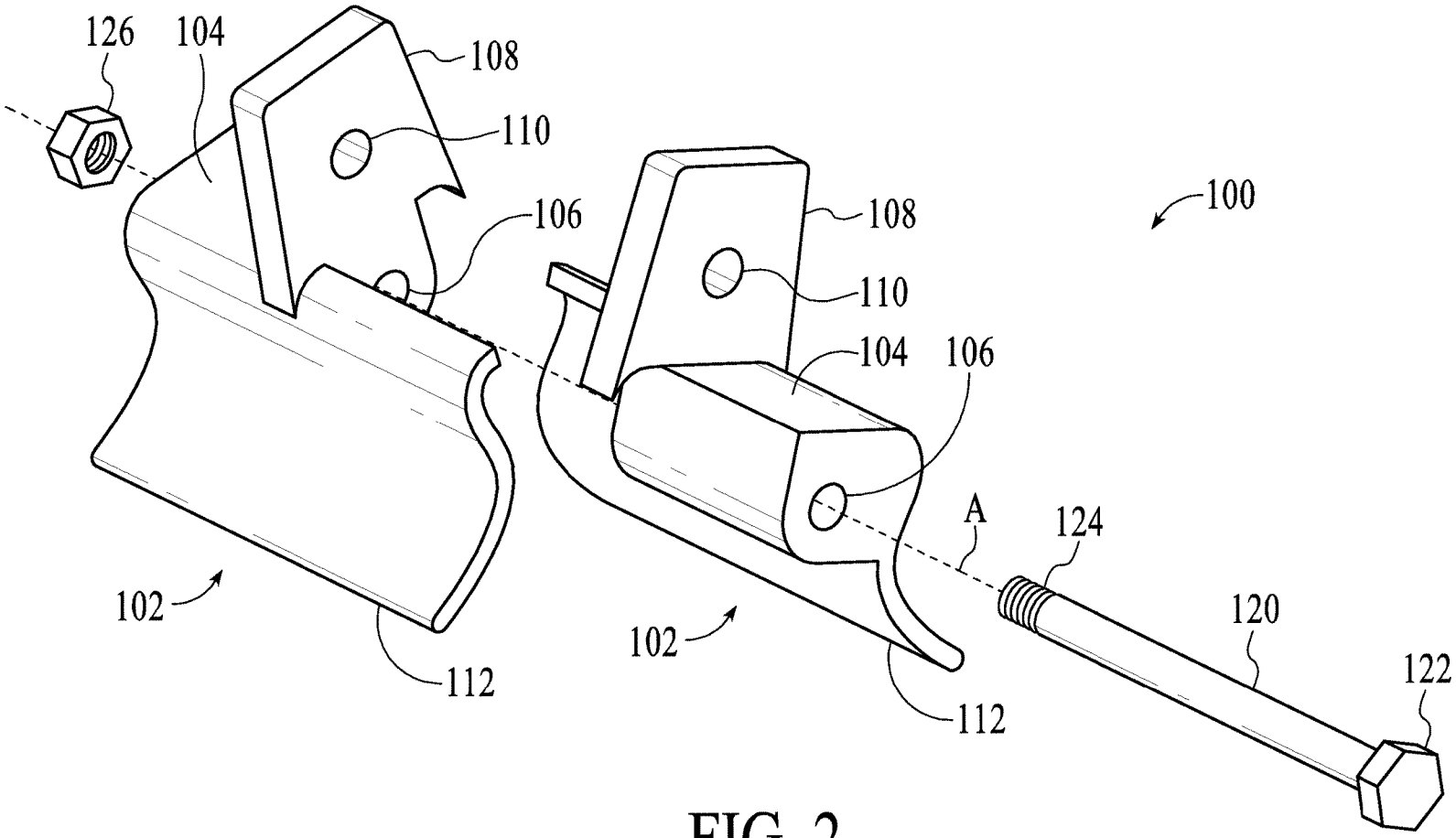
FIG. 2 is an exploded isometric view of the butterfly handle locking device of the present invention.

FIG. 2 is an exploded isometric view of the butterfly handle locking device 100 of the present invention. An embodiment of the sportsboard and sportscraft locking device 100 of the present invention has two main body portions 102 that fit together. Each main body portion 102 has a central region 104 with an axial bore 106. A flange 108 having a shackle bore 110 extends from the central region 104 of each main body portion 102 in a plane perpendicular to the central axis A, with the flange 108 on a first main body portion 102 immediately adjacent the flange 108 on a second main body portion 102. A wing arm structure 112 extends from the central axis A of each main body portion 102.

The two main body portions 102 are secured together in axial alignment by an axle 120. The axle 120 could be a bolt 120 with a head 122 at one end and screw threads 124 at the other end, and a nut 126. In addition, the axle 120 could also be a lock or jam pin that fits securely at the ends but allows rotation of the two main body portions 102. Thus, the entire device 100 is a unitary assembly. The butterfly handle locking device 100 can be formed using any suitable, rigid material such as, but not limited to, regular and hardened metal, hardened steel, stainless steel, polymeric material including plastic and rubber, fiberglass, resin-based material, composite and injection-molding substrate, etc.

Figure 3A:
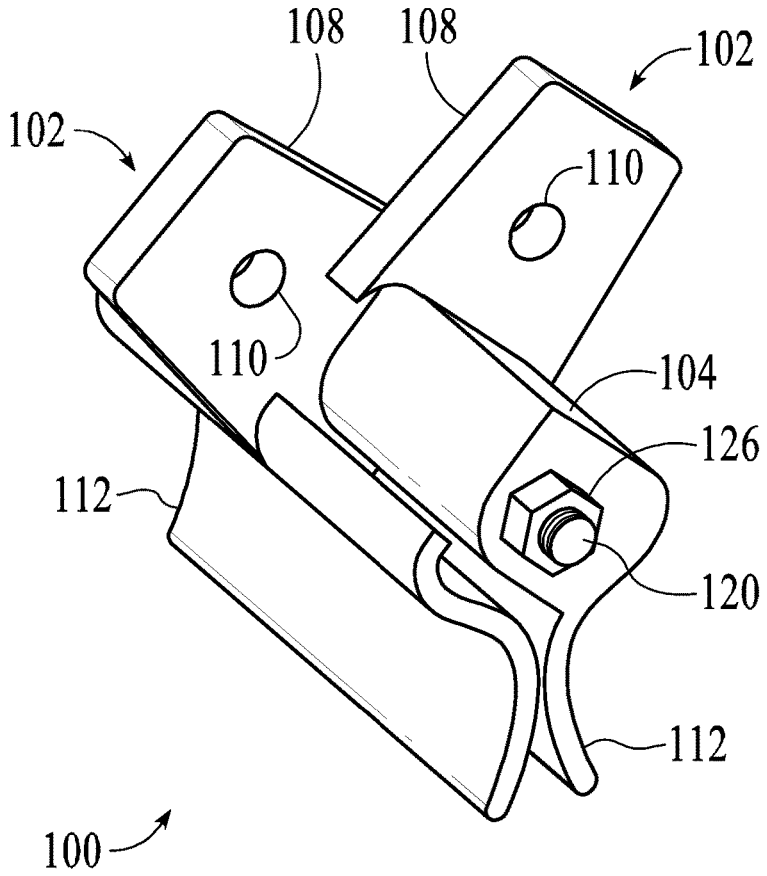
FIG. 3A is an isometric view of the butterfly handle locking device of the present invention in the unlocked position.
Figure 3B:
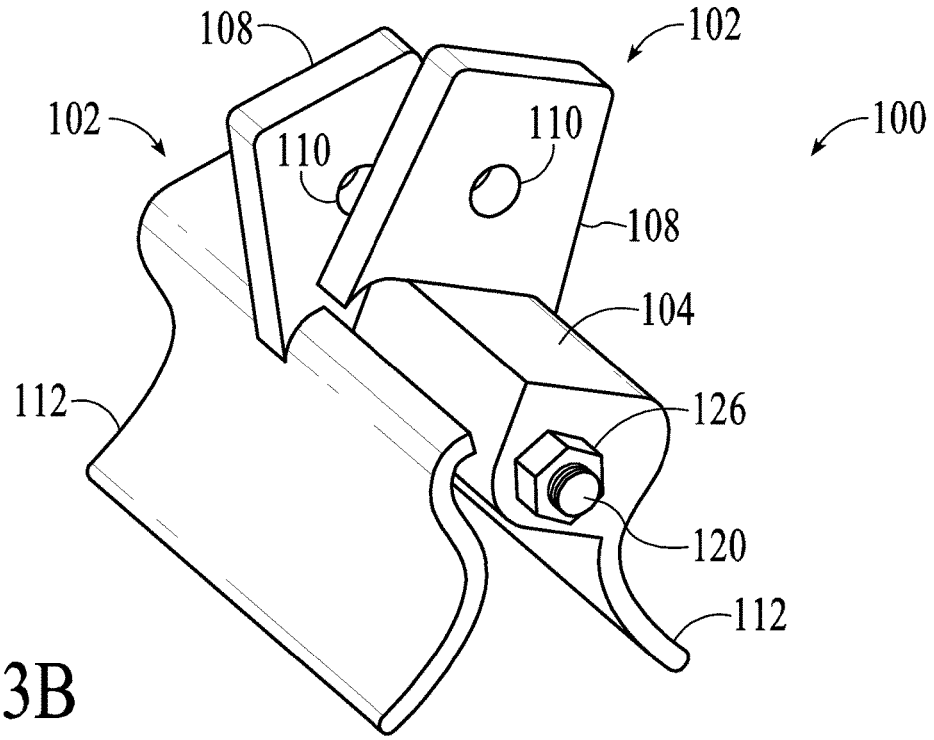
FIG. 3B is an isometric view of the butterfly handle locking device of the present invention in an intermediate position.
Figure 3C:
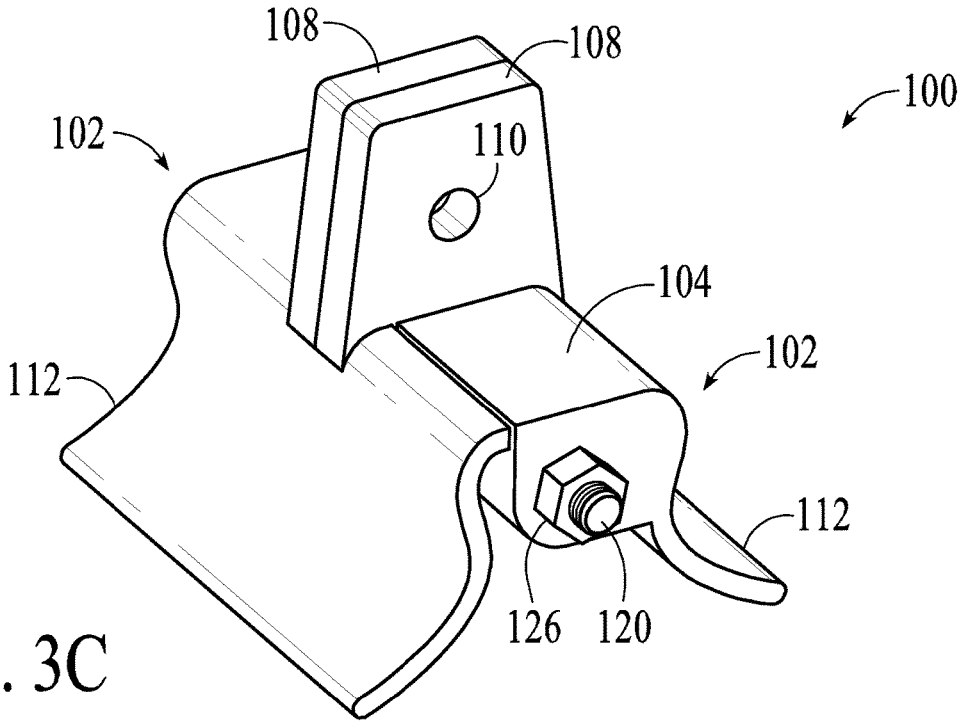
FIG. 3C is an isometric view of the butterfly handle locking device of the present invention in the locked position.

FIGS. 3A-3C are isometric views of the butterfly handle locking device of the present invention in the unlocked, intermediate and locked positions, respectively. When the flanges 108 on the main body portions 102 are pivoted such that the flanges 108 are away from each other, the wing arms 112 of the two main body portions 102 pivot closer together as best shown in FIG. 3A. This would commonly be referred to as an "unlocked" position because the wing arms 112 are folded together and unable to be secured between the handle lobes 86 of the butterfly handle 90. However, when the flanges 108 are pivoted together they pass through an intermediate position as best shown in FIG. 3B. As the flanges 108 continue to pivot together so that they overlap and the shackle bores 110 line up, the wing arms 112 pivot away from each other into a fully spread open position as best shown in FIG. 3C. In this fully spread open position the wing arms would be locked inside the interior space 94 and unable to pass through the gap B between the two lobe handles 86 of the butterfly handle 90.

Figure 4A:
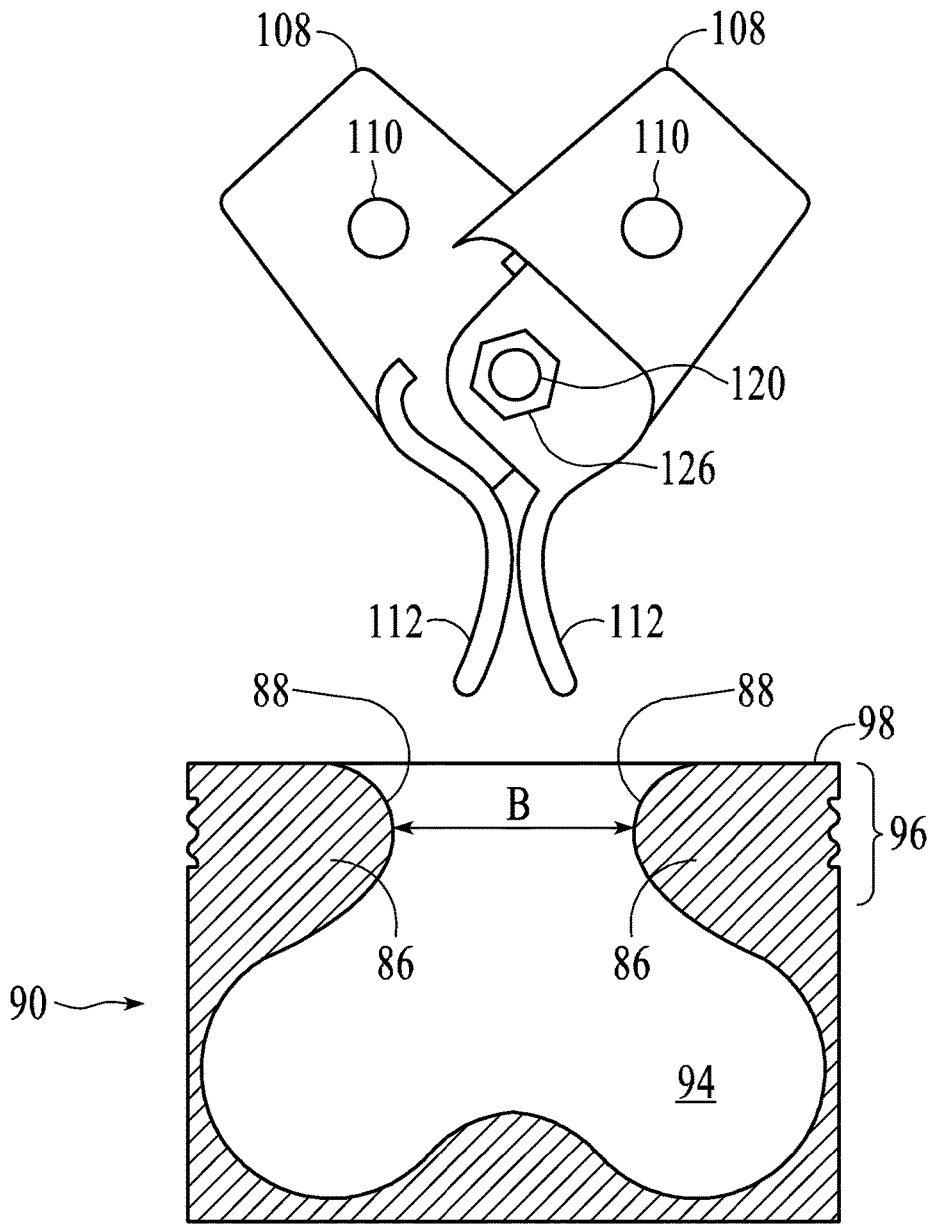
FIG. 4A is a section view of the butterfly handle locking device of the present invention in the unlocked position adjacent a typical butterfly handle.
Figure 4B:
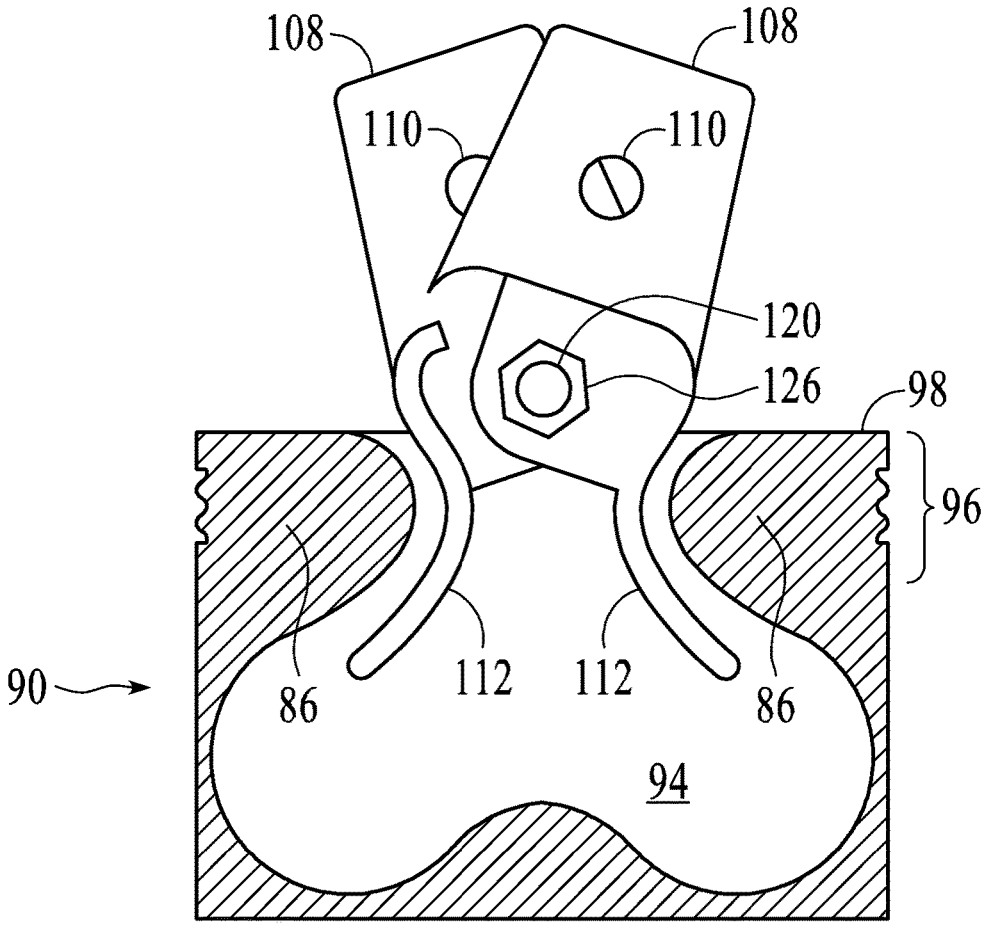
FIG. 4B is a section view of the butterfly handle locking device of the present invention in an intermediate position disposed partially within a typical butterfly handle.
Figure 4C:
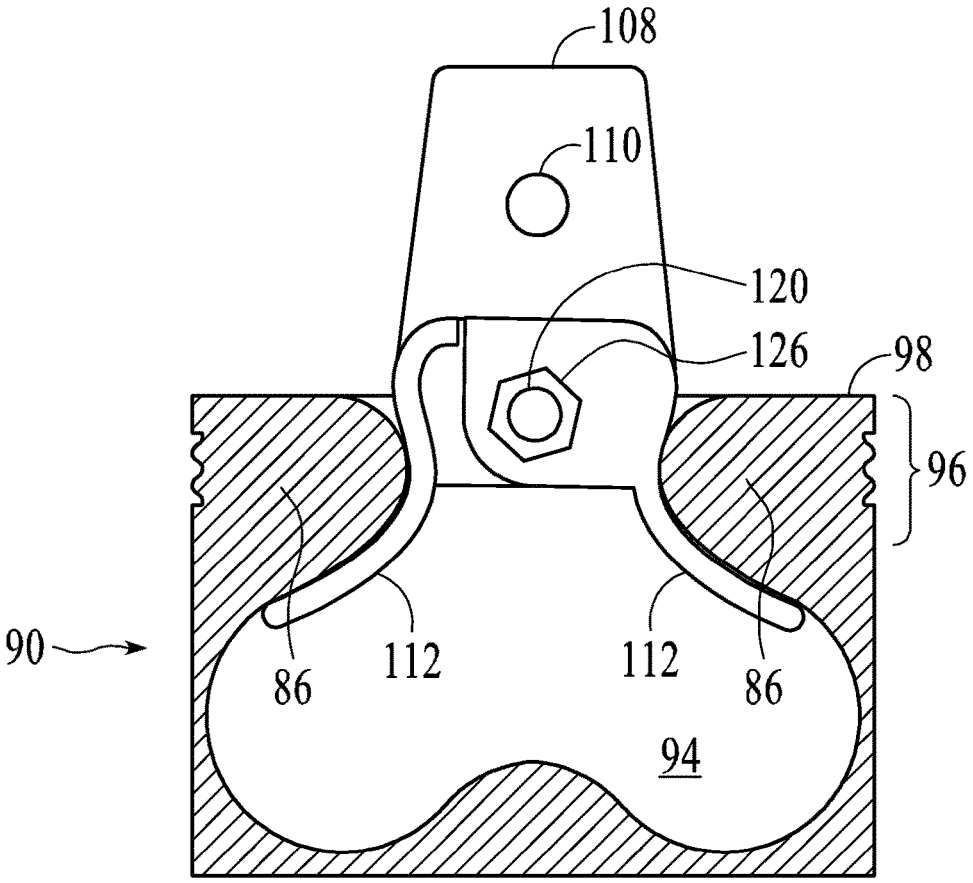
FIG. 4C is a section view of the butterfly handle locking device of the present invention in the locked position installed in a typical butterfly handle.

FIGS. 4A-4C are section views of the butterfly handle locking device of the present invention in the unlocked position adjacent a typical butterfly handle, in an intermediate position disposed partially within a typical butterfly handle, and in the locked position installed in a typical butterfly handle. The three positions of the butterfly handle locking device 100 shown in FIGS. 4A-4C are essentially equivalent to and correspond directly with those shown in FIGS. 3A-3C.

As described above, when the flanges 108 on the butterfly handle locking device 100 are separated, the wing arms 112 swing together and the lower portion of the device 100 can be inserted through the opening B of the handle 90, as best shown in FIG. 4A. As the flanges 108 are pivoted together, they begin to overlap. In addition, in the intermediate position as best shown in FIG. 4B, the wing arms 112 begin to spread apart and occupy the interior space 94 of the handle 90. Finally, once the flanges 108 are pivoted together so that they completely overlap, the shackle bores 110 align and the wing arms 112 assume a fully spread open position. In this locked position, the butterfly handle locking device 100 is secured to the handle 90 and the wing arms 112 are spread too far open to be able to pass back through the opening B between the handle lobes 86.

Figure 5A:
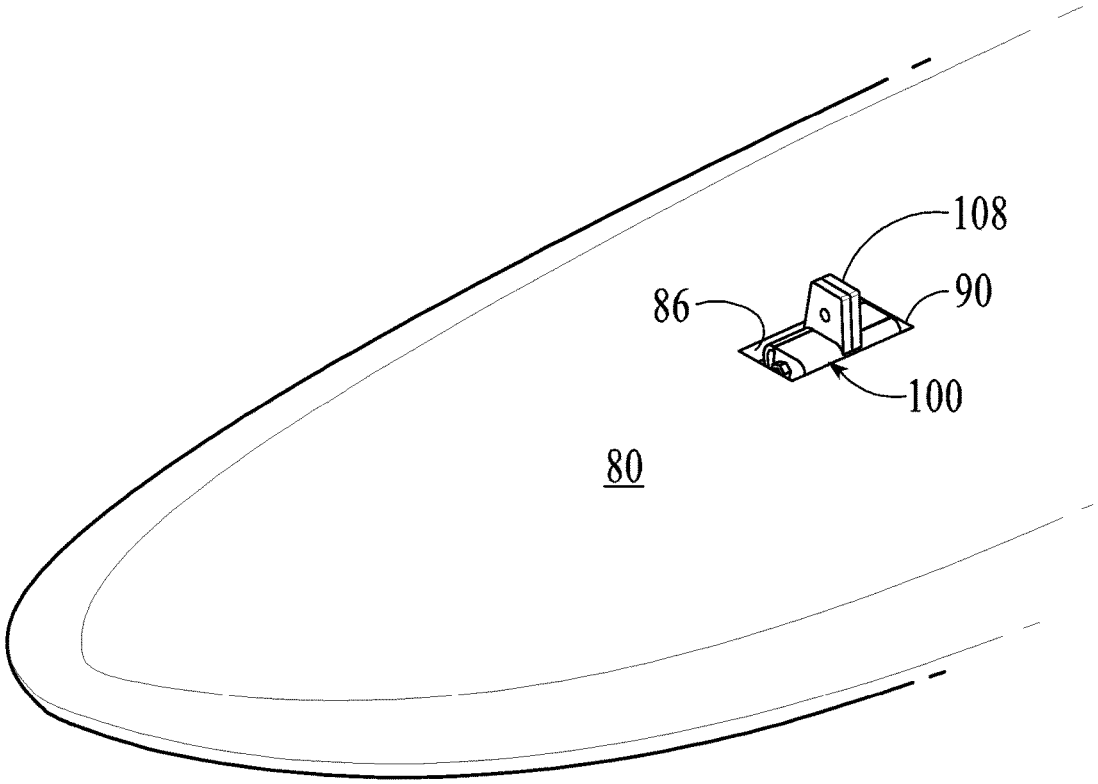
FIG. 5A is an isometric view of the butterfly handle locking device of the present invention in the locked position installed in a typical butterfly handle mounted on a sportsboard or sportscraft.
Figure 5B:
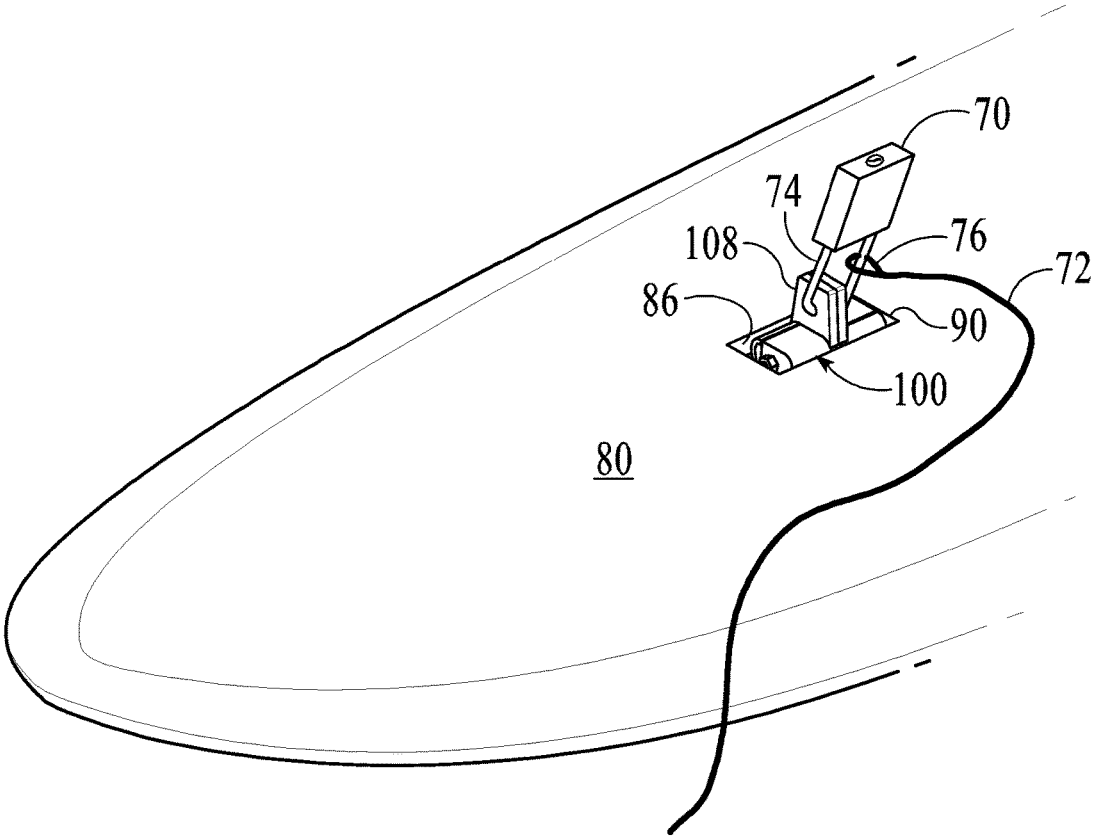
FIG. 5B is an isometric view of the butterfly handle locking device of the present invention in the locked position installed in a typical butterfly handle mounted on a sportsboard or sportscraft with padlock and cable.

FIGS. 5A-B are isometric views of the butterfly handle locking device 100 of the present invention in the locked position installed in a typical butterfly handle 90 mounted on a sportsboard or sportscraft 80 without padlock 70 and cable 72 and with padlock 70 and cable 72, respectively. It will be understood that once the flanges 108 of the two main body portions 102 line up flush with each other and the shackle bores 110 in the two flanges 108 align as shown in FIGS. 3C and 4C, the butterfly handle locking device 100 is in a locked position. The shackle arm 74 of a padlock 70 can pass through both of the shackle bores 110 and also pass through the spliced eyelet end 76 of the cable 72 before closing.

It will be understood that various padlocks 70, cable 72, chains and other flexible connectors and locking devices may be used as desired for securing the two flanges 108 of the main body portions 102 and preventing them from separating. Thus, the sportsboard or sportscraft 80 can be locked with a padlock 70 and cable 72 or chain to essentially anything, for example a roof-top or rear rack or carrier, inside a truck or other vehicle, to a larger boat, or to any other object as desired. It will also be understood that butterfly handles 90 of various shapes and sizes are used commonly on a range of products from sportsboards and sportscraft to large shipping boxes, packaging for electronic appliances, and on home appliances as well as commercial equipment.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A butterfly handle locking device to temporarily secure a padlock shackle to a butterfly handle, the butterfly handle comprised of a housing with interior space defined by two separate curved lobe ergonomic handle portions, the butterfly handle locking device comprising;

a first main body portion and a second main body portion that fit together, each of the first and second main body portions having a central region with an axial bore, a first flange having a shackle bore extending from the central region of the first main body portion in a plane perpendicular to the central axis, a second flange having a shackle bore extending from the central region of the second main body portion in a plane perpendicular to the central axis and parallel to the first flange, a first wing arm extending from the central axis of the first main body portion in a plane perpendicular to the first and second flanges, a second wing arm extending from the central axis of the second main body portion also in a plane perpendicular to the first and second flanges, the first and second main body portions secured together in axial alignment by an axle passing through the axial bore of the first main body portion and the axial bore of the second main body portion, whereby when the flanges on the main body portions are pivoted about the central axis away from each other, the wing arms of the two main body portions pivot closer together and fit into the interior space of the butterfly handle, but when the flanges are pivoted toward each other so that they overlap and the shackle bores line up and the padlock shackle can be inserted through the aligned shackle bores, the wing arms pivot away from each other in different, non-parallel planes within the interior space of the butterfly handle and become locked into a fully spread open position underneath the separate lobes of the ergonomic handle portions of the butterfly handle, thereby preventing removal of the locking device from the butterfly handle.

2. The butterfly handle locking device of claim 1 wherein the axle passing through the axial bores of the first and second main body portions comprises:

a bolt with a head at one end and screw threads at the other end; and a nut that threads onto the bolt.

3. The butterfly handle locking device of claim 1 wherein the axle passing through the axial bores of the first and second main body portions comprises a lock or jam pin that fits securely but allows rotation of the first and second main body portions.

4. The butterfly handle locking device of claim 1 formed using material selected from the group of materials consisting of regular and hardened metal, polymeric material including plastic and rubber, fiberglass, resin-based material, composite, injection-molding substrate.

5. The butterfly handle locking device of claim 1 further comprising a locking shackle with a shackle arm that fits through the shackle bores of the first flange and the second flange.

6. The butterfly handle locking device of claim 5 in which the locking shackle is a padlock.

7. The butterfly locking device of claim 1 further a comprising flexible connector selected from the group of flexible connectors consisting of cables and chains.

8. A method for temporarily securing as sportsboard or other object containing a butterfly handle with a padlock, the butterfly handle comprising a housing with interior space defined by two separate curved lobe ergonomic handle portions, the method comprising the following steps:

Obtaining a butterfly handle locking device comprising:

A first main body portion and a second main body portion that fit together, each of the first and second main body portions having a central region with an axial bore;

A first flange having a shackle bore extending from the central region of the first main body portion in a plane perpendicular to the central axis and a second flange having a shackle bore extending from the central region of the second main body portion in a plane perpendicular to the central axis, and parallel to the first flange;

A first wing arm extending from the central axis of the first main body portion in a plane perpendicular to the first and second flanges and a second wing arm extending from the central axis of the second main body portion also in a plane perpendicular to the first and second flanges; and An axle passing through the axial bore of the first main body portion and the axial bore of the second main body portion such that the first and second main body portions are secured together in axial alignment, wherein the method comprises the following steps:

A. Pivoting the first and second flanges on the main body portions about the central axis away from each other such that the wing arms of the two main body portions pivot closer together;

B. Inserting the locking device into the interior space of the butterfly handle;

C. Pivoting the first and second flanges toward each other so that they overlap and the shackle bores line up, and the wing arms pivot away from each other in different planes within the interior space of the butterfly handle and become locked into a fully spread open position underneath the separate lobes of the ergonomic handle portions of the butterfly handle; and C. Inserting a shackle portion of a padlock through the aligned shackle bores, thereby preventing removal, of the locking device from the butterfly handle.

* * * * *